US005285767A

United States Patent [19]

Padilla

[11] Patent Number: 5,285,767

[45] Date of Patent: Feb. 15, 1994

[54] SHOCK ABSORPTION IN ARCHERY SIGHTS

[76] Inventor: Robert Padilla, 1702 Rosewood Dr., Monrovia, Calif. 91016

[21] Appl. No.: 944,168

[22] Filed: Sep. 11, 1992

[51] Int. Cl.[5] ..... F41B 5/00

[52] U.S. Cl. ..... 124/87; 124/86; 124/80

[58] Field of Search ..... 124/87, 88, 89, 86, 124/80; 33/265

[56] References Cited

U.S. PATENT DOCUMENTS

| | | | |
|---|---|---|---|
| 3,412,725 | 11/1968 | Hoyt | 124/89 |
| 3,524,441 | 8/1970 | Jeffery | 124/89 |
| 4,245,612 | 1/1981 | Finlay | 124/89 |
| 4,607,606 | 8/1986 | Schaar | 124/88 |
| 4,615,327 | 10/1986 | Saunders | 124/89 |
| 5,072,716 | 12/1991 | Sappington | 124/87 |
| 5,152,068 | 10/1992 | Meister | 124/87 |

*Primary Examiner*—Eric K. Nicholson
*Assistant Examiner*—Anthony Knight
*Attorney, Agent, or Firm*—Christie, Parker & Hale

[57] ABSTRACT

An apparatus for use with an archery bow in defining a flexible connection of selected resilience in the structural path between the handle riser of an archery bow and the sighting element of a archery sight, the apparatus comprises an elastomeric member of selected geometry and resilience to cause the member to normally hold the member substantially normal to corresponding structures in use of the member between the structures, and separation connection means coupled to opposite ends of the member for movement relative to each other on deformation of the member.

15 Claims, 4 Drawing Sheets

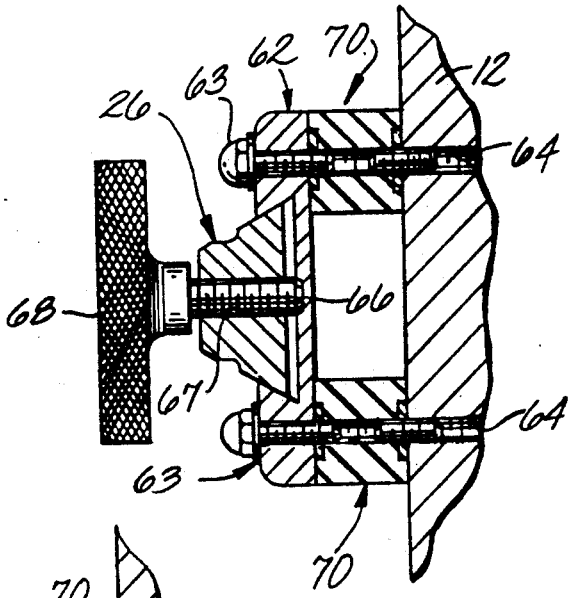
Fig. 4
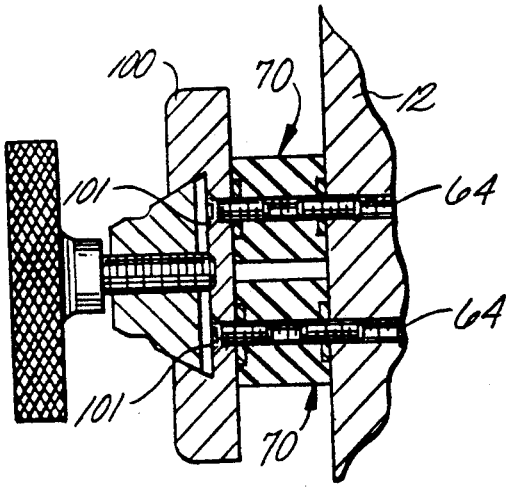
Fig. 7
Fig. 6
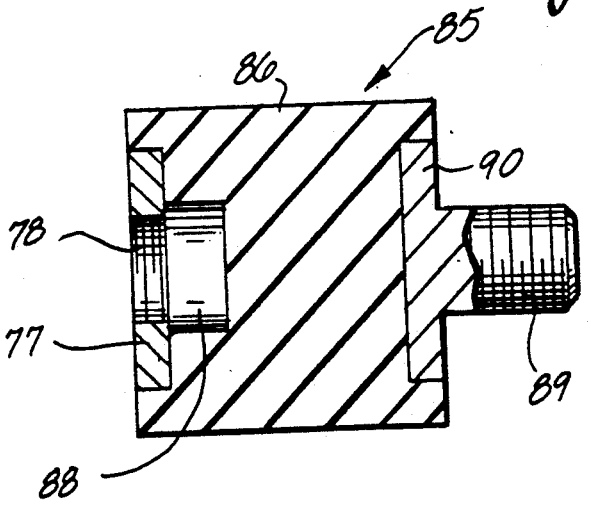

SHOCK ABSORPTION IN ARCHERY SIGHTS

FIELD OF THE INVENTION

The present invention relates generally to an archery accessory. More particularly, it relates to resilient shock-absorbing connections in the structural path between the handle riser of an archery bow and the sighting element of an archery sight mountable or mounted to the bow, for the purpose of reducing shocks and vibration transmitted to the sighting element from the bow upon release of an arrow from the drawn bow.

BACKGROUND OF THE INVENTION

Sighting devices are commonly used as accessories to archery bows to enable archers to more accurately aim bows in target shooting and in hunting. Some of the available archery sights, notably those used in competition target shooting events, are complex mechanisms which have relatively delicate components, such as the actual sighting elements. A sighting element commonly is supported on the handle riser of the bow via interconnecting members which are also components of the overall sight mechanism. The sight mechanism commonly is constructed so that the sighting element is positionally adjustable relative to the handle riser in each of three orthogonally related directions. Those directions can be referred to as the x (parallel to the direction of arrow flight which may be substantially horizontal), y (substantially horizontal and perpendicular to the x direction), and z (substantially vertical and perpendicular to both of the x and y directions) directions. The archer adjusts the position of the sighting element in the necessary combination of the x, y and z directions relative to the handle riser so that, when the archer places the sighting element on a line from his sighting eye to a target, the bow is properly aimed in terms of that archer's aiming stance, the range or distance to the target, and such windage factors as may be known or have been estimated, all in the context of that particular bow and the arrow being used. Once that adjustment of the sight mechanism has been made by the archer, it is desired that such adjustment remain fixed in the sight mechanism unless and until a change in that adjustment is needed to accommodate changes in shooting conditions, such as a change in range or windage factors. Maintenance of a desired sight mechanism adjustment state is a problem.

The problem exists because of the dynamic events which occur in a bow as it is released from a drawn condition in use of the bow. Irrespective of whether the bow is of the recurved kind or of the compound kind, the bow is stressed to some base level in its strung but undrawn state. In that state of the bow, the bowstring is taut and the bow limbs are modestly flexed. When the bow is fully drawn preparatory to release of an arrow, the bow limbs are more highly flexed and store energy which will be applied to the arrow via the bowstring to propel the arrow along its intended flight path. Upon release of the bow from its fully drawn state, the bow limbs and the bowstring move very rapidly and violently back to their strung but undrawn relation. They reach that relation in what is equivalent to a crash stop, which creates a sudden shock in the bow structure and in accessories mounted to the bow. Among other effects, that shock can cause the several elements of a bow sight to move relative to each other and, as a consequence, to cause the sight to lose its desired state of adjustment. It is not uncommon for repeated occurrences of such shocks to cause components of a bow sight to break. The most commonly broken sight component is the sight element itself and the member which directly supports the sight element. A loss of adjustment of a bow sight impairs the ability of the archer to accurately aim the bow. Breakage of a sight component has more obvious results.

It is seen, therefore, that a need exists for devices which can be used in and in combination with archery sight mechanisms to enhance the ability of a sight to maintain a desired state of adjustment during repeated use of a bow to which the sight is mounted, and to reduce or eliminate breakage of sight components due to the effects of applied shock loads. The need noted above is particularly acute in a new kind of archery competition and event—undefined distance shooting—in which the distances from the shooting line to the target are not stated to the archer and in which the targets are three-dimensional models of game animals. In such competition events, the archer uses very light arrows to obtain high initial arrow velocities so that flat arrow trajectories can be achieved. Because the arrows are light, they do not absorb as much energy from the bow as do heavier arrows. As a result, when light arrows are being used, the bows crash and slam and make much noise as they reach an undrawn state upon release from a drawn state. It is common in such competition for a sight element to break loose from its supports, at least once.

SUMMARY OF THE INVENTION

The present invention addresses the need identified above. It provides a simple, effective, and efficient resilient shock-absorbing connection in the structural path between an archery bow handle riser and the archery sighting elements. Because of the simplicity and relatively-low cost of the present invention, an archer can have an inventory of a number of such devices having different elastic characteristics suited to different performance characteristics of compound bows and recurved bows used by that archer.

Generally speaking, the present invention provides an improved apparatus for use with an archery bow. The apparatus defines a flexible shock-absorbing connection in the mounting of an archer's sighting element to the handle riser of an archery bow. The sighting element is a component of an archery sight, which is mountable to the handle riser. The apparatus comprises an elastomeric member of selected geometry and resilience. Separate connection means are affixed to opposite ends of the elastomeric member for movement relative to each other upon deformation of the member, at least one of which is cooperable with a connection feature of the sight which exists as a characteristic of the sight as such.

BRIEF DESCRIPTION OF THE DRAWINGS

The previously mentioned features and advantages of the invention, as well as other features and advantages of the invention, will be more apparent from a reading of the following detailed description of the presently preferred and other embodiments of the invention in conjunction with the accompanying drawings in which:

FIG. 4 is a section view taken along line 4—4 in FIG. 2;

FIG. 6 is an enlarged cross-sectional elevation view of another form of shock absorbing unit useful in the sight; and FIG. 7 is a view similar to that of FIG. 4 showing another manner of mounting of the sight to a bow handle riser via shock absorbing units according to this invention.

DETAILED DESCRIPTION

Figure 1:
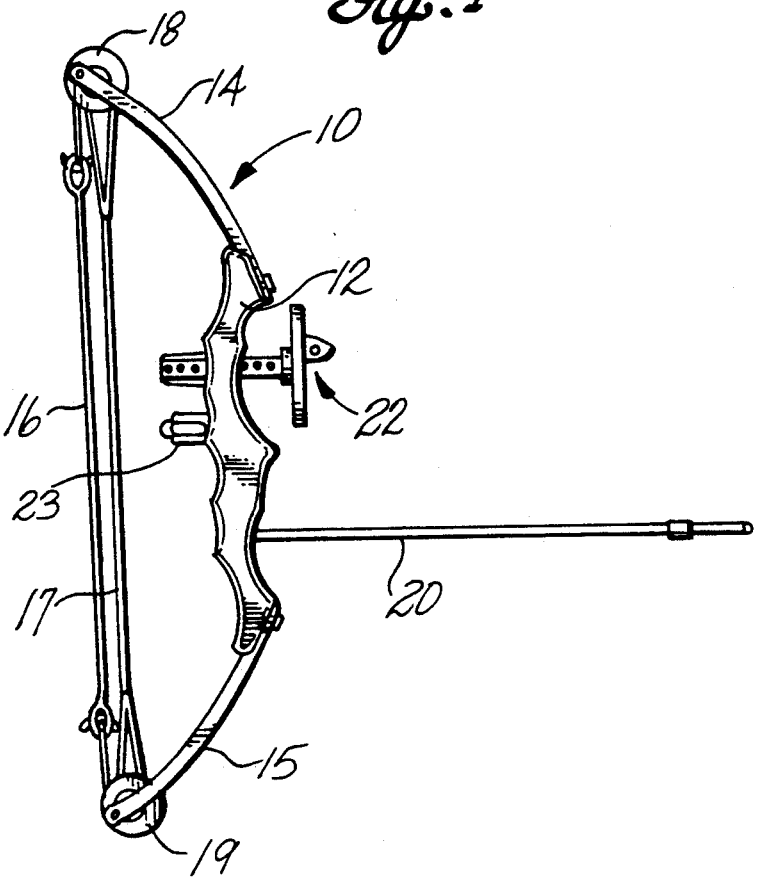
FIG. 1 shows an archery bow having attached thereto an archery sight which includes shock absorbing units in accordance with the present invention.

FIG. 1 shows the right side of a compound archery bow 10 of a conventional type having a rigid handle riser portion 12 to the opposite ends of which are affixed upper and lower resiliently flexible limbs 14 and 15. A bowstring 16 is connected between a pair of cables 17 which extend in a known manner over cam-action pulleys 18 and 19 carried by limbs 14 and 15. A stabilizer 20 is engaged into a threaded opening in the forward face of the riser. An archery sight 22 is attached to the left side face of the riser 12. An arrow rest 23 is attached to the left riser face below sight 22. Archers will recognize that the sight may be mounted to the right face of the riser depending upon whether the archer holds the bow in the left or right hand or sights with the left or right eye.

As noted above, the improvement in archery accessories provided by this invention is a shock absorbing unit, one or more of which can be used as additions to an existing archery sight in desired places in the sight structure to protect the delicate sighting element of the sight from damage by shocks applied to the sight in use and to prevent the sight components from moving out of adjustment because of such shocks. Therefore, the invention is illustrated and described in the context of a known, commercially available archery sight. More specifically, the sight used for purposes of example in the following description and in the accompanying drawings is a Toxonics sight mechanism; other known sights, such as those sold under the names Check-It or Accura could have been selected as examples of sights in which the device of the present invention can be used to advantage. Accordingly, except for the shock absorbing devices therein, the sight structure 22 shown in FIGS. 2, 3, 4 and 7 is that of a known Toxonics bow sight.

The principal components of sight 22, as sold by its maker, are a horizontal bar 26, a vertical bar 28, a sighting assembly 30 and sighting assembly carriage assembly 32 which is slidably engagable with the vertical bar and is fixable to the vertical bar in a desired adjusted position on the vertical bar. The vertical bar of sight 22 as assembled by its manufacturer normally is fixedly connected to a forward end of horizontal bar 26 via cap headed machine screws 33 which pass through holes in vertical lugs 34, carried at the forward end of the horizontal bar, and into suitably sized tapped holes (not shown) in a rear face 35 of the vertical bar. The rear face of the vertical bar normally is rigidly clamped to the forward face of the horizontal bar and its lugs by screws 33.

The forward portion of the vertical bar defines a channel 36 which opens along the entire length of the vertical bar through the central portion of a forward face 37 of the vertical bar. That channel, which has opposing in-turned lips adjacent face 37, receives a pair of slide elements 39 (see FIG. 3) which are components of carriage assembly 32 and which are associated with clamping knobs 40 and 41, respectively, of the carriage assembly. Knob 40 is a primary lock knob and knob 41 is a secondary lock knob. Each lock knob is a part of a respective primary 43 and secondary 44 slide assembly, which assemblies are also components of carriage assembly 32. The slide assemblies are interconnected by a drive screw 45 which is operated by a drive knob 46 which is captive in the primary slide assembly. The primary slide assembly 43 is locked to vertical bar 28 by operation of knob 40 to define a gross adjustment position of that slide assembly while the secondary slide assembly 44 (which carries sighting assembly 30) is slidable on the vertical bar. Drive knob 46 is then operated to drive the secondary slide assembly toward or away from the primary slide assembly on the vertical bar into a finely adjusted position of the secondary slide assembly which corresponds to the desired vertical (elevation) position of the sighting assembly on the bow; thereafter, the secondary slide assembly is securely clamped to the vertical bar by operation of knob 41.

The sighting assembly 30 includes a tubular barrel 48 in which is carried a lens 49 having an opaque sight dot 50 in its center. A bubble level 51 is carried across the lower portion of the barrel adjacent the lens so that an archer using sight 22 can readily see the sight dot and the level together. In sight 22 as normally assembled by its maker, barrel 48 is held by an Allen head set screw 53 against the enlarged head 54 of a slide shaft 55 which is horizontally disposed in secondary slide assembly 44 for only slidable movement transversely of the length of vertical bar 28. Screw 53 is accessible through a hole 57 formed in the barrel in alignment with the screw at a location in the barrel diametrically opposite the screw. Axial motion of shaft 55 is guided by a tube 58 and is produced by a detented knob 59 which cooperates with a threaded stud 60 carried by the shaft; the stud coacts with a threaded bore through knob 59 to advance or retract shaft 55 with or against the bias of a spring (not shown) inside the tube around the stud. Operation of knob 59 produces lateral movement of the sighting assembly so that windage adjustments in the sight can be made.

The parallel top and bottom edges of horizontal bar 26 are bevelled to define a male component of a dovetail slidable connection between the horizontal bar and a mounting bracket 62 for sight 22. As shown in FIG. 4, the mounting bracket serves as a base for the sight and defines the female component of the dovetail sliding connection. The base normally is mountable directly to bow handle riser 12 by means of cap headed machine screws 63 which pass through holes in upper and lower luglike margins of the mounting bracket into tapped holes 64 defined in riser 12. Holes 64 are a standardized feature of currently available compound and recurved bows. They are located a specified distance apart from each other and tapped to receive 10-24 threaded machine screws. The horizontal bar and bracket 62 are wedged into fixed relation to each other by use of a threaded shaft 66 engaged in a cooperatively threaded hole 67 formed transversely through the horizontal bar;

shaft 66 is carried by a relatively large diameter clamp knob 68. The end of the shaft opposite the knob bears on the base of the female dovetail groove in bracket 62 to wedge the bar into the bracket. A plurality of holes 67 are formed through bar 22 at spaced locations along the bar to define a number of possible positions of the bar relative to the handle riser from which the bar extends forwardly in a direction perpendicular to the vertical extent of the riser.

The above-described feature of a bow handle riser and of sight 22 are known. As set forth above, in that known sight, bracket 62 is screwed directly to the side of riser 12 via screws 63 and holes 64. The sight vertical bar is affixed rigidly and directly to the forward end of the sight horizontal bar via screws 33 which are threaded into suitably tapped holes in the rear face of the vertical bar. The sighting assembly 30 is connected directly to carriage assembly 32 via screw 53 which acts to hold barrel 48 on shaft 55. It will be apparent, therefore, that when the bow to which such a known sight is mounted is subjected to shock on release of the bow from its drawn state, the shocks experienced by the bow are transmitted to all parts of the sight without damping or attenuation. Those shocks cause the sight component to move relative to each other so that the desired elevation and windage adjustments of the sight are not maintained. Also, in many cases, the shocks cause screw 53 to break in the connection between barrel 48 and shaft head 54.

Figure 2:
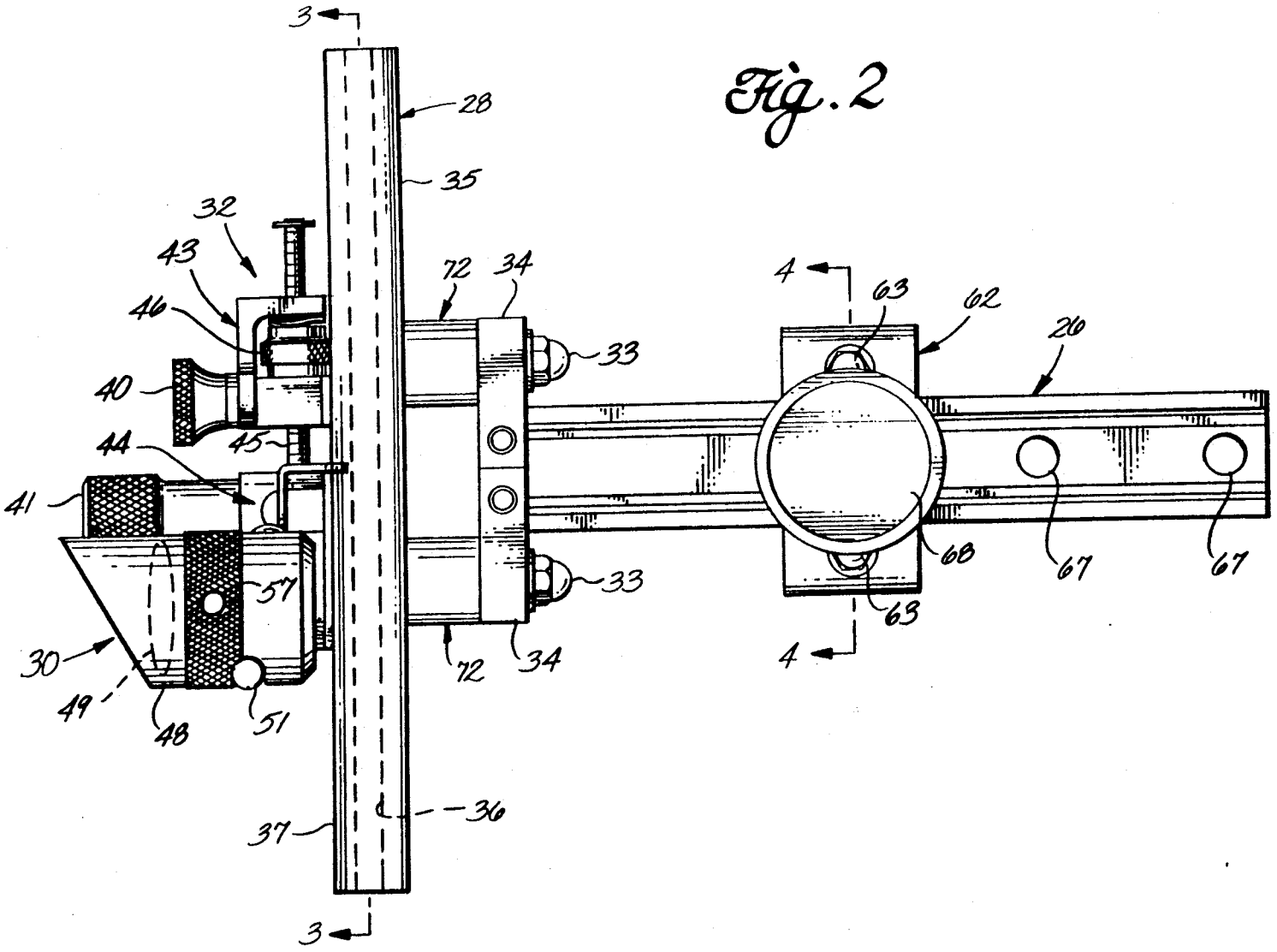
FIG. 2 is an enlarged left side elevational view of the archery sight.
Figure 3:
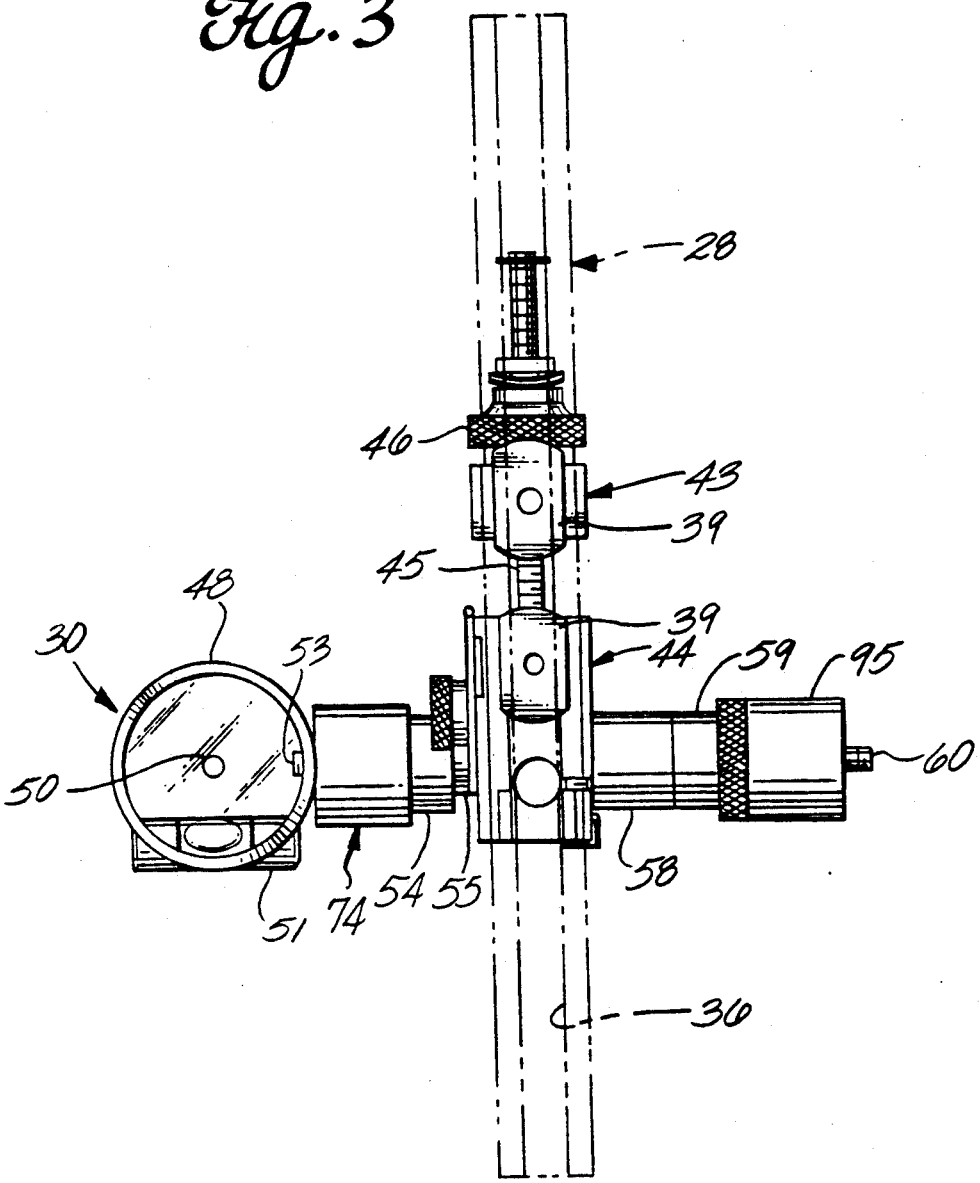
FIG. 3 is a view taken along line 3—3 in FIG. 2.

An inspection of FIG. 2, 3 and 4 in light of the foregoing description of sight 22 will reveal that the sight, as illustrated in those FIGS., has components which were not mentioned in that description. Those components are shock absorbing devices according to this invention. More specifically, they are shock absorbers 70, a pair of which is interposed between handle riser 12 and the mounting bracket 62 for sight horizontal bar 26 (see FIG. 4), shock absorbers 72, a pair of which is interposed between the forward end of horizontal bar 26 and vertical bar 28 (see FIG. 2), and a shock absorber 74 which is interposed between barrel 48 and shaft head 54 (see FIG. 3). Each of those shock absorbers cooperate with connection features of sight 22 which are present in the sight as the sight normally is manufactured.

Figure 5:
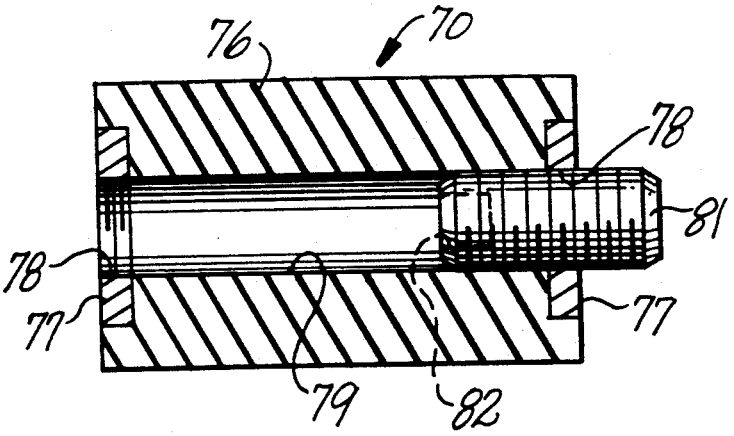
FIG. 5 is an enlarged cross-sectional elevation view of a shock absorbing unit useful in the sight shown in FIG. 2 and 3.

The several shock absorbers 70, 72 and 74 are structurally similar to each other; therefore only a shock absorber 70 is described in detail with reference to FIG. 5. The description of shock absorber 70 will be understood to serve as a description of the essential aspects of shock absorbers 72 and 74.

Shock absorber 70 is comprised principally of a preferably cylindrical elongate resiliently deformable elastomeric member 76 which forms the body of the device. At each of its ends, the resilient body carries a connection element which is separate from the connection element at the opposite end of the body. The connection element, in each instance, is or includes an axially threaded metal washer-like plate 77 which preferably is bonded into the resilient body preferably flush with the adjacent end of the body.

The threaded holes 78 in the two plates preferably are coaxially aligned and preferably are located at opposite ends of a bore 79 through the body. The bore has a diameter which is at least equal to the diameter of the largest of holes 78. Preferably, holes 78 are of equal diameter and are similarly threaded. Because shock absorber 70 is to be used in the connection of sight bracket 62 to handle riser 12, the threads in holes 78 preferably are threads defined for cooperation with a 10–24 male thread. One of holes 78 receives a stud 81 having 10–24 male threads. The stud can be provided as set screw having an Allen-socket 82 at its end toward bore 79; the other end of the set screw stud projects beyond the adjacent end of body 76. It will be apparent that shock absorber 70 can be mounted to riser 12 by cooperation of stud 81 in a riser hole 64, and that the sight mounting bracket 62 can be connected to the shock absorber using one of screws 63. In that way, a pair of shock absorber 70 can be used to mount sight 22 to riser 12.

Shock absorbers 72 have unstudded ends which cooperate with screws 33, and studded ends which thread into the vertical bar holes provided for receipt of screws 33. Thus, two shock absorbers 72 can be used to shock mount sight vertical bar 28 to the forward end of horizontal bar 26.

Shock absorber 74 has an unstudded end which receives screw 53 of lens barrel 48, and a studded end which threads into a hole in shaft head 54 into which screw 53 normally would be threaded. Shock absorber 74 shock mounts the lens barrel to the carriage assembly of sight 22.

Shock mounts according to this invention can be used in sight 22 at one, some, or all of the three locations shown in the drawings. Because the connection of the lens barrel to the carriage assembly is the most delicate connection in the sight, it is preferred that at least shock absorber 74 be used. That shock absorber preferably is relatively soft. If either or both of shock absorbers 70 and 72 are used in the sight, it is preferred that both are harder (stiffer) then shock absorber 74, and that absorbers 70 are stiffer than absorbers 72.

Another form of shock absorber 85 according to this invention is shown in FIG. 6. It has a cylindrical resilient elastomeric body 86 to one end of which is secured, as by bonding, a plate 77 having a central internally threaded hole 78 aligned with a cavity 88 in the body. The other end of the body carries an externally threaded stud 89 having a disc-like head 90 secured, as by bonding, to body 86. Stud 89 is a one-piece equivalent of stud 81 and its receiving plate 77 as shown in FIG. 5.

FIG. 7 shows how shock absorbers 70 can be used to connect a mounting bracket 100, provided in a different sight for supporting a sight horizontal bar, to a bow handle riser. Bracket 100 provides countersunk mounting holes in the base of the female dovetail groove in which flathead 10–24 machine screws 101 can be received for securing the bracket directly to riser 12 via holes 64. Shock absorbers 70 can be interposed between bracket 100 and the riser to shock mount the sight to the riser. Suitably sized and configured shock absorbers according to this invention can be used at other locations in the sight as desired.

The shock absorbers have sufficient stiffness to stably support the related sight components relative to the bow during the time when the archer draws and aims the bow before release of an arrow. As one moves further along the structural path from the handle riser to the sighting elements of the sight, the weight of the sight to be supported by shock absorbers decreases, and the absorber bodies can be made softer and yet still stably support the sight components carried by them. Each absorber body is sufficiently resilient to enable it to be deformed angularly under shock between the connectors carried by it to absorb shock energy and so protect, to one degree or another, the sight elements further away from the riser along that path.

Shock absorbing members of different angular stiffness provided by this invention are readily interchangeable one for another to suit an archer's needs when using different styles of bows or when using one bow for different purposes. For example, in hunting and competition target shooting, the compact shock absorbing members can be provided with different degrees of stiffness against bending by varying the hardness of the rubber or other elastomer used to define the shock absorbing members. Also, because the shock absorbing members are small and inexpensive, the archer can readily afford to maintain an inventory of different absorbers, all configured for use in a pertinent sight, for use in the sight under different conditions.

The presently preferred hardness of a resilient shock absorbing member according to this invention is 45 Durometer within a preferred range of from about 30 to about 60 Durometer.

An unstudded shock absorber 70, i.e., one which does not include stud 81, can be used as a lock member 95 on shaft 60 in association with knob 59. The lock member serves as a locknut relative to knob 59 to hold the windage adjustment of sight 22 from loosening and changing during use of the sight.

Use of the shock absorber 74 directly adjacent lens barrel 48 essentially eliminates breaking of sight 22 due to the shock loads encountered when shooting very light arrows.

The shock absorbing members provided by this invention, being of low weight, add minimum weight to a bow and do not impair the normal performance of the sight in which they are installed.

The foregoing description of the presently preferred and other embodiments of this invention has been presented for purposes of illustration and example of the principles and features of the invention. Thus, the description is not exhaustive of all of the structural and procedural forms in which the invention can be embodied or practiced. Therefore, the foregoing descriptions are supportive of, and not narrowly limiting upon the scope of the invention and of the following claimed definitions of the invention.

What is claimed is:

1. An apparatus for use in defining a flexible connection of selected resilience between a horizontal bar of an archery bow sight and an elongate handle riser of an archery bow, the handle riser and the sight horizontal bar being adapted for substantially direct connection to each other, the apparatus comprising:

an elastomeric member of selected geometry and having resilient properties selected and defined to cause the member to normally hold the sight horizontal bar substantially normal to the length of handle riser in use of the member between said riser and said bar; and separate connection elements coupled to opposite ends of the member for movement relative to each other on deformation of the member and for coupling the opposite ends of the member respectively to the sight horizontal bar and to the bow handle riser.

2. An apparatus as defined in claim 1, wherein the connection elements comprises at least one externally-threaded male coupling of selected dimensions and threads for engaging with a sight mounting hole of the handle riser.

3. An apparatus for use in defining a flexible connection of selected resilience between a horizontal bar and a vertical bar of an archery bow sight, the horizontal bar and the vertical bar being adapted for substantially direct connection to each other, the apparatus comprising:

an elastomeric member of selected geometry and having resilient properties selected and defined to cause the member to normally hold the sight horizontal bar substantially normal to the sight vertical bar in use of the member between said bars; and separate connection elements coupled to opposite ends of the member for movement relative to each other on deformation of the member and adapting the member for incorporation directly into the connection of the bars to each other.

4. An apparatus as defined in claim 3, wherein the connection elements comprises at least one externally-threaded male coupling of selected dimensions and threads for engaging with a mounting hole of the sight vertical bar.

5. An apparatus for use in defining a flexible connection of selected resilience between a sighting element and a sighting element support of an archery bow sight, the sighting element and its support being adapted for substantially direct coupling to each other, the apparatus comprising:

an elastomeric member of selected geometry and having resilient properties selected and defined to cause the member to normally hold stationary the sighting element relative to the sighting element support in use of the member between said element and said support; and separate connection elements coupled to opposite ends of the member for movement relative to each other on deformation of the member and adapting the member for incorporation directly into the coupling of the sighting element to its support.

6. An apparatus as defined in claim 5, wherein the sighting element comprises a lens and a level indicator.

7. Apparatus for defining a flexible shock-absorbing connection in the mounting of an archer's sighting element to the handle riser of an archery bow, the sighting element being a component of an archery sight which is mountable to the handle riser, the apparatus comprising an elastomeric member of selected geometry and resilience, and separate connection elements affixed to opposite ends of the elastomeric member for movement relative to each other upon deformation of the member and at least one of which is cooperable with a connection feature of the sight which exists as a characteristic of the sight as such.

8. Apparatus as defined in claim 7, wherein said one connection element comprises a threaded shaft.

9. Apparatus as defined in claim 7, wherein said one connection element comprises a metal element bound to the elastomeric member at one end thereof and defining therein an internally-threaded hole, the threads of which are mateable with a threaded fastener which exists in the sight as such.

10. In the combination of an archery bow having a handle riser and an archery sight mounted to the riser and including a sighting element which is positionally adjustable relative to the riser, the improvement comprising a resilient shock-absorbing connection in the structural path between the handle riser and the sighting element.

11. Apparatus as defined in claim 10, wherein the shock-absorbing connection is proximate the sighting element.

12. Apparatus as defined in claim 10, wherein the shock-absorbing connection comprises a connection of the sight to the handle riser.

13. Apparatus as defined in claim 10, wherein the sight includes a first member which is mounted for movement substantially normal to an elongate extent of the handle riser, and a second member which is connected to the first member and is movable substantially parallel to the riser's elongate extent, and wherein the shock-absorbing connection is between the first and second members.

14. Apparatus as defined in claim 11, wherein there is a second resilient connection more proximate the handle riser in said path, and the connection proximate the sighting element is of lesser stiffness than the second connection.

15. An archery bow sight comprising a sighting element, and mounting means which are positionally adjustable yet securable in fixed interrelation for mounting the sighting element on a bow handle riser and for vertical and lateral adjustment of the position of the sighting element relative to the riser, and a flexible and resiliently deformable coupling of the sighting element to a portion of the mounting means located substantially next adjacent the sighting element.

* * * * *